US009237805B2

(12) United States Patent
Grainger

(10) Patent No.: US 9,237,805 B2
(45) Date of Patent: Jan. 19, 2016

(54) STORAGE SYSTEM

(76) Inventor: Allan Grainger, South Glamorgan (GB)

( * ) Notice: Subject to any disclaimer, the term of this patent is extended or adjusted under 35 U.S.C. 154(b) by 0 days.

(21) Appl. No.: 13/379,125

(22) PCT Filed: Apr. 30, 2010

(86) PCT No.: PCT/GB2010/050714

§ 371 (c)(1),
(2), (4) Date: Dec. 19, 2011

(87) PCT Pub. No.: WO2010/146378

PCT Pub. Date: Dec. 23, 2010

(65) Prior Publication Data

US 2012/0097689 A1 Apr. 26, 2012

Related U.S. Application Data

(60) Provisional application No. 61/218,585, filed on Jun. 19, 2009.

(51) Int. Cl.

| | |
|---|---|
| ***B65D 6/06*** | (2006.01) |
| ***A47B 88/10*** | (2006.01) |
| *B65D 6/04* | (2006.01) |

(52) U.S. Cl.
CPC ..... *A47B 88/10* (2013.01)

(58) Field of Classification Search
CPC ... A47B 88/10; A47B 88/0466; B65D 21/086
USPC ..... 220/720, 4.03, 8
See application file for complete search history.

(56) References Cited

U.S. PATENT DOCUMENTS

| | | | | |
|---|---|---|---|---|
| 958,857 | A * | 5/1910 | Dennis | 220/8 |
| 3,463,343 | A * | 8/1969 | Asenbauer | 220/8 |
| 3,887,102 | A * | 6/1975 | Earley | 220/8 |
| 4,805,794 | A * | 2/1989 | Tsuchiya et al. | 220/8 |
| 4,909,406 | A * | 3/1990 | Wu | 220/8 |
| 5,056,458 | A * | 10/1991 | Askeland | 118/505 |
| 5,641,082 | A | 6/1997 | Grainger | |
| 5,855,291 | A * | 1/1999 | Ingle | 220/6 |
| 6,059,130 | A | 5/2000 | Grainger | |
| 6,227,397 | B1 * | 5/2001 | Kim | 220/8 |
| 6,415,938 | B1 * | 7/2002 | Karpisek | 220/1.5 |
| 6,863,003 | B2 | 3/2005 | Grainger | |
| 7,140,502 | B2 | 11/2006 | Grainger | |

(Continued)

FOREIGN PATENT DOCUMENTS

| | | | |
|---|---|---|---|
| WO | 8703791 | A1 | 7/1987 |
| WO | 2009052558 | A1 | 4/2009 |

*Primary Examiner* — Mickey Yu
*Assistant Examiner* — Niki Eloshway
(74) *Attorney, Agent, or Firm* — Clinton H. Wilkinson; Charles A. Wilkinson

(57) ABSTRACT

A storage system including a first component (102), and an extendable component (130) slidably mounted on the first component. The extendable component includes a pair of side members (132) spaced apart to accommodate a container (150) in use and at least one base member (132) arranged to support a lower surface of the container in use. The extendable component includes a first fixing arrangement (138) located at or adjacent one end of the extendable component and a second fixing arrangement (134) located at or adjacent another end, in use, the first and second fixing arrangements being configured to releasably engage with members on a container supported by the extendable component.

12 Claims, 3 Drawing Sheets

(56) References Cited

U.S. PATENT DOCUMENTS

| | | | | |
|---|---|---|---|---|
| 7,401,756 | B2 * | 7/2008 | Lien et al. | 248/346.07 |
| D623,821 | S | 9/2010 | Grainger | |
| D623,822 | S | 9/2010 | Grainger | |
| D625,529 | S | 10/2010 | Grainger | |
| D639,448 | S | 6/2011 | Grainger | |
| 8,016,370 | B2 | 9/2011 | Grainger | |
| D647,684 | S | 10/2011 | Grainger | |
| 2007/0194018 | A1 * | 8/2007 | Mashburn | 220/1.5 |
| 2007/0278169 | A1 * | 12/2007 | Grainger | 211/186 |

* cited by examiner

DETAIL C
REAR PIN

DETAIL D
REAR PIN SLOT

DETAIL A
FRONT PIN

DETAIL B
FRONT SLOT

DETAIL H
FRONT PIN
LATCHED

DETAIL E
PIN ALIGNED WITH
FRONT SLOT

STORAGE SYSTEM

This application is the national stage of PCT/GB2010/050714, filed Apr. 30, 2010, which claims priority from U.S. Provisional Patent Application Ser. No. 61/218,585, filed Jun. 19, 2009, the disclosures of which are incorporated herein by reference.

FIELD OF THE INVENTION

The present invention relates to a storage system.

BACKGROUND OF THE INVENTION

Restraining containers in storage racks and the like can be particularly problematic when the racks are onboard moving vehicles. When being transported by aircraft, the racks can be subjected to considerable forces, e.g. 3-5 G. Usually, a large number of ropes, etc are required to tie the items in this situation, but this takes up a considerable amount of time and means that removing the containers is also an awkward and time-consuming process. This is clearly disadvantageous when the contents need to be unloaded quickly. It can also be difficult to correctly load and unload items from a container that is on an uneven (or moving) surface. The rack may slope and so the rails upon which the container rests can be misaligned vertically.

SUMMARY OF THE INVENTION

Embodiments of the present invention are intended to address at least some of the problems outlined above.

According to a first aspect of the present invention there is provided a storage system including:

a first component, and an extendable component slidably mounted on the first component;

the extendable component including a pair of side members spaced apart to accommodate a container in use and at least one base member arranged to support a lower surface of the container in use, wherein the extendable component includes a first fixing arrangement located at or adjacent one end of the extendable component and a second fixing arrangement located at or adjacent another end, in use, the first and second fixing arrangements being configured to releasably engage with members on a container supported by the extendable component.

The first component may include a pair of spaced apart side members and the side members of the extendable component may be directly or indirectly slidably mounted on the side members of first component.

The first component may include at least one member for fixing the first component to a rack or framework. The at least one member may be located at or adjacent a rear end of the first component.

The system may further include a further extendable component, the firstmentioned extendable component being indirectly slidably mounted on the first component by being slidably mounted on the further extendable component, with the second extendable component being slidably mounted on the first component.

The first component may include a fixing device (which may be located at or adjacent a front end of the first component) arranged to fix the extendable component in a non-extended configuration with respect to the first component. The fixing device may include a shot bolt type arrangement, which may be biased, e.g. by a spring, to an engaging position. The extendable component may include an arrangement, e.g. a closed loop, for receiving the fixing device. The receiving arrangement may be located at or adjacent a front end of the extendable component and may extend outwardly from a said side member of the extendable component.

The extendable component may include a rear wall extending at least partially between inner surfaces of the two side members of the extendable component. The rear wall may include the first fixing arrangement. The first fixing arrangement may include at least one aperture and the container may include at least one corresponding projection that, in use, fits into the at least one aperture, thereby preventing relative vertical movement of the container and the extendable member. Alternatively, the rear wall may include at least one projection and the container may include at least one corresponding aperture.

The second fixing arrangement may include an arrangement for receiving a protrusion on a side surface of the container. The second fixing arrangement may include a pivotable clasp or latch. The clasp or latch may have a profile designed to allow the protrusion to slide into a recess where the clasp/latch closes around the protrusion. The clasp/latch may be biased, e.g. by means of a spring.

The container may be a box including a removeable or pivotable lid.

According a further aspect of the present invention there is provided a container including rear and front fixing arrangements configured to cooperate with a storage system substantially as described herein.

According to another aspect of the present invention there is provided storage apparatus including a storage system substantially as described herein and at least one container. The apparatus may further comprise a rack for mounting the storage system.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWING FIGURES

The invention may be performed in various ways, and, by way of example only, embodiments thereof will now be described, reference being made to the accompanying drawings in which.

Figure 2A:
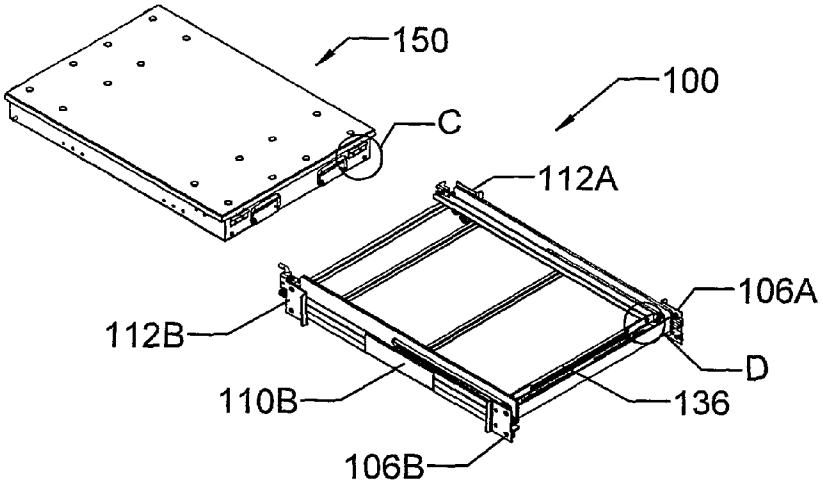
FIG. 2A is a perspective view of the container and the storage system in a non-extended configuration.
Figure 2B:
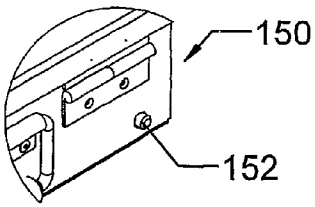
Figure 2C:
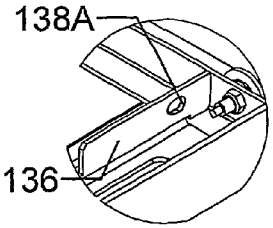
Figure 3A:
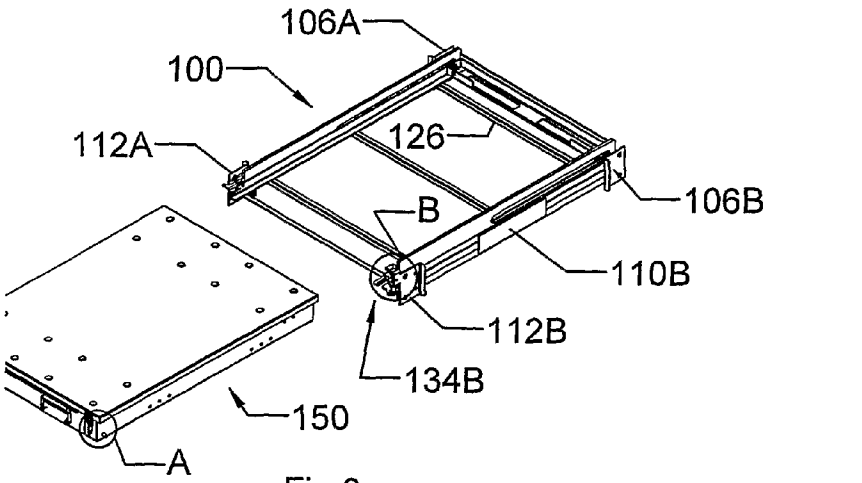
Figure 3B:
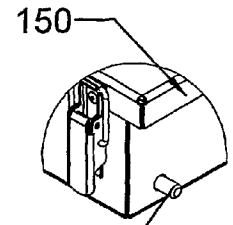
Figure 3C:
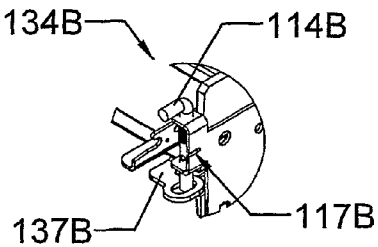
Figure 4A:
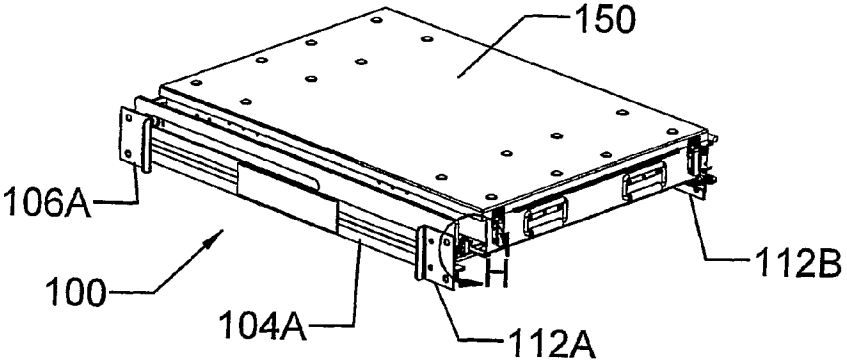
Figure 4C:
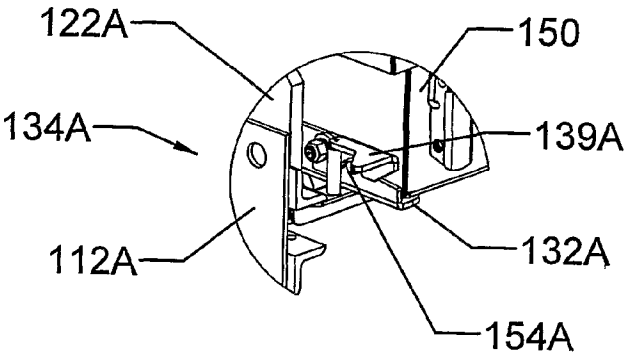
Figure 4B:
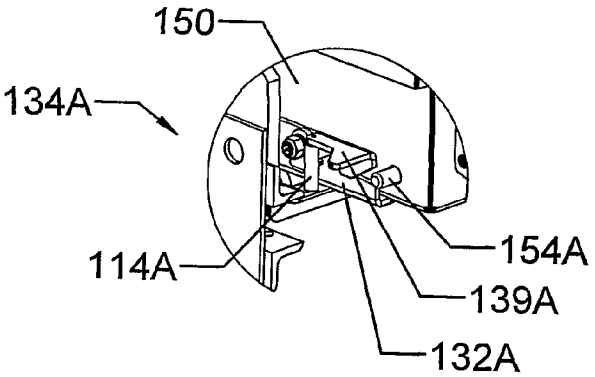

FIG. 2B details a rear corner of the container;

FIG. 2C details a rear fixing arrangement of the storage system;

FIG. 3A is an alternative perspective view of the container and storage system;

FIG. 3B details a front corner of the container;

FIG. 3C details a front fixing arrangement of the storage system;

FIG. 4A is a perspective view of the container fitted on the storage system, which is in a non-extended configuration, and FIGS. 4B and 4C detail engagement of the front fixing arrangement.

DETAILED DESCRIPTION OF THE INVENTION

Figure 1:
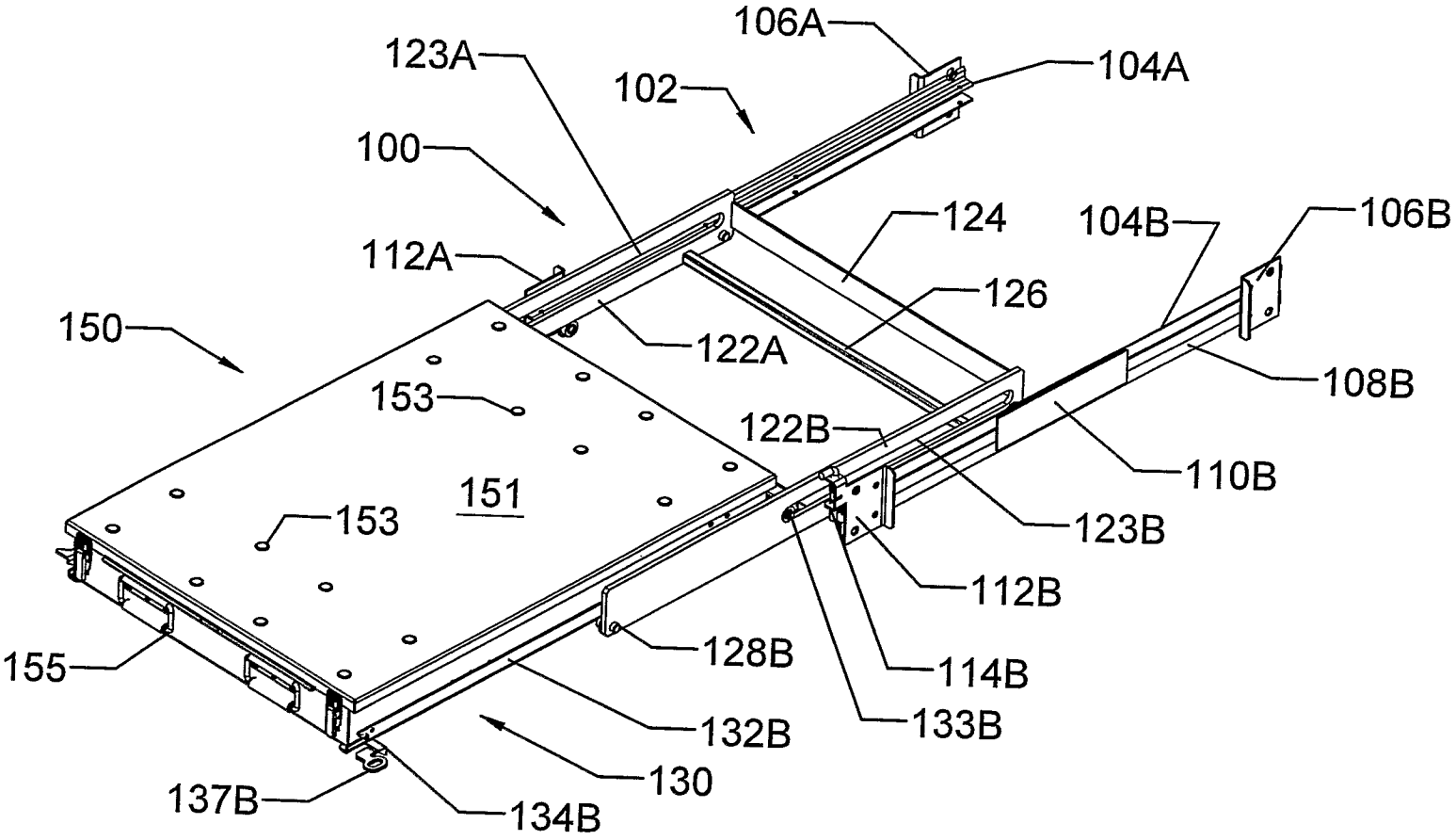
FIG. 1 is a perspective view of a container and an example storage system in an extended configuration.

Referring to FIG. 1, an example storage system 100 is shown. The parts of the system can be formed of any suitable material(s), such as wood or metal, and can be dimensioned to accommodate any desired container(s), typically heavy-duty ones having a base formed of steel with a width of around 686 mm and a length of around 1066 mm, but it will be understood that this is just one example and variations are possible. The system includes a first component 102 comprising a pair of spaced-apart elongate side members 104A, 104B. At one end (referred to herein as the "rear end") of each of the side members there is provided a fixing arrangement 106A, 106B. The fixing arrangements are designed to allow the side members to be fixed in a spaced apart manner to another body, such as a rack or framework, e.g. those sold by Rack International (UK) Limited of Merthyr Tydfil, UK. The example fixing arrangement includes a plate with formations intended to allow it to be fixed, e.g. by bolts or welding, to the body, but it will be appreciated that the design can vary, or may be further integrated into the side members. Several of the systems can be connected to the rack, thereby providing a set of drawer-like storage arrangements for several containers.

Each of the side members of the illustrated example include two individual elongate members that can be fixed together by the plates 106A, 106B, as well as additional plates (only one, 110B, is visible in the Figure) and front-end plate 112A, 112B. At least one of the front-end plates is fitted with a shot bolt 114A, 114B, the operation of which will be described below.

The side members 104A, 104B each include a track arrangement 108A, 108B that allow a middle extendable component 120 to be slidably mounted on the first component 102. It will be understood that any suitable sliding arrangement may be used in the storage system, e.g. low-friction runners or rollers. The middle extendable component includes a pair of spaced-apart side elongate members 122A, 122B. At least one member extends between the side members to connect them together, see the side wall 124 and lower bar 126 of the illustrated example. The fixing arrangements 106 can include stops for preventing travel of the component 120 past the rear end of the system, or such a stop may be provided by the rack/shelving.

Slidably mounted on the middle extendable component is a container-supporting extendable component 130. Component 130 includes a pair of elongate side members (only one, 132B, is visible in the Figure). In the illustrated example, the sliding mounting is provided by means of a slot 123A, 123B in each of the side members of the middle extendable component 120 into which corresponding side protrusions/rollers 133A, 133B located near the rear end of the component 130 are slidably mounted. The inner surfaces of the side members 122 also include a roller (only one, 128B, is visible in the Figure) near its front end, over which the side members 132 of the component 130 can slide. It will be understood that other sliding/roller arrangements can be used, e.g. low-friction plastic materials/sliders.

Each side member 132A, 132B can have L-shaped profiles arranged as mirror images of each other, with their bases directed towards the space between the two side members. The base of the L-shapes can therefore support the lower surface of a container 150 in use. Alternatively, other base member(s) may extend between the side members in order to provide such support. The front end of each side member 132A, 132B includes a fixing arrangement (only one, 134B, is visible in the Figure), which will be described in more detail below.

In alternative embodiments, middle extendable component 120 may not be present (i.e. a container-supporting component extends directly from the first component 102), whilst in other embodiments there may be more than two extendable components.

The container 150 in the example is a rectangular box with a removeable/pivotable lid 151. At least one gas-strut (not shown) may be fitted within the container to hold the lid. This helps prevent the lid from being closed inadvertently and also allows a person to use both hands to access the contents of the box without having to hold it open. The lid can include formations 153 (e.g. projections) that can engage with corresponding formations (e.g. bores) in a lower surface of another similar container in order to help securely stack the containers. The container can also include one or more handles 155.

Turning to FIG. 2A, a rear perspective view of the system 100 with the container 150 not yet supported within it is shown. The middle 120 and container-supporting extendable components 130 are in non-extended positions. The Figure shows a rear wall 136 of the container-supporting component 130 and part of this wall is detailed in the FIG. 2C. As can be seen, the wall includes an upstanding portion with an aperture 138A located towards one of the side members, and can also include a similar portion/aperture (not detailed) located towards its opposite side end. It will be appreciated that the design of the portion/aperture is exemplary only and variations are possible, e.g. the aperture can be located in the main body of the rear wall, or the fixing arrangement may be located on a side surface near the rear of the container/storage system.

FIG. 2B details a lower portion of the container 150. As can be seen, the outer rear surface of the container 150 includes a projection 152 that (in use, when the surface is brought into contact with the rear wall 136 of the component 130) protrudes into a corresponding one of the apertures 138. This engagement helps prevent relative vertical movement of the container and storage device.

FIG. 3A is an alternative perspective view of the system shown in FIG. 2A and FIG. 3C details an example of the fixing arrangement 134B and a bolt arrangement 114B that mounted on front plate 112B. As shown in FIG. 3C, when the container-supporting component is in a fully un-extended position, the bolt 114B can be pushed down into an aligned closed loop 137B that extends outwardly from a side surface of the side member 132B (near its front end). The bolt may be biased downwards by means of a spring or the like, which helps hold the engagement with the loop 137B when in use. When the bolt is not engaged then its head can be rotated and held in a recess 117B in the front plate 112B. The other side of the system can also include a similar bolt/loop/plate arrangement.

FIG. 3B details part of the front corner of the container 150. The side surface of the container includes a protrusion 154B towards its front end. There can also be a protrusion (not visible) on a corresponding location on the opposite side surface of the container.

Referring to FIGS. 4A-4C, in use, extendable members 120 and 130 are typically drawn out so that the container 150 can be loaded onto the container-supporting component 130 and then slid over the L-shaped side members 132A, 132B towards the rear end of the storage system. As the container 150/component 130 is pushed in the rearward direction, the extendable components 120 and 130 can slide back to their un-extended positions. When the rear end of the container reaches the rear wall 136 of the component 130, the container rear projections 152 protrude into the apertures 138 as described above.

Further, the side projections 154 of the container 150 can also engage with the fixing arrangements 134 on the side members 132 of the component 130. In the example of FIGS. 4B and 4C the fixing arrangement comprises a latch member 139A pivotably connected to a point near the front end of the side member 132A of the component 130 (a corresponding fixing arrangement can be located on the opposite side member). The latch member can include an angled/profiled lower surface that allows the side projection 154A to slide underneath it, pivoting the latch upwards. The latch member then includes a recessed portion and when the side projection reaches this point, the latch can pivotably drop downwards (as shown in FIG. 3C). The rear surface of the angled/profiled portion of the latch then abuts the front of the side projection, meaning that the component 130 should not be able to travel in a forwards direction until the latch is released. The latch may be biased to help assist with this engagement and it will be understood that variations to the illustrated fixing arrangement are possible, e.g. a profiled shape/detent on the side member without a pivotable latch could be used to achieve a temporary engagement.

The invention claimed is:

1. A system for restraining containers in a storage rack comprising:

a first component including a pair of spaced-apart elongate side members each having a front end and a rear end, each of the first component side members including a pair of individual elongate members which are fixed together by at least two spaced-apart plates, and a closed track formed between the first component elongate side members, the plate located closest to the rear end of each of the first component side members having formations for fixing the side members in a spaced-apart manner to a rack or framework, and a bolt member fitted to at least one of the plates located closest to the front end of the first component side members, a container supporting component slidably mounted between fully extended and un-extended positions to the first component elongate side member tracks having a pair of spaced-apart L-shaped elongate side members arranged as mirror images of each other, a rear wall extending between the container supporting component side members, one or more base members, a clasp or latch member pivotably connected to at least one of the container supporting component side members along a front end of the side member, an aperture located on the rear wall or a surface of the container supporting component side members near the rear wall, and a loop member extending outwardly from a side surface near the front end of a container supporting component side member in a location to receive the bolt member on the first component side member when the container supporting component is in a fully un-extended position with respect to the first component, and a container having front, rear, side, and lower surfaces, and a lid member, the lower surface adapted to be slidably supported on the one or more base members of the container supporting component between the container supporting component side members, a first projection on the rear surface or a side surface near the rear surface of the container which when the rear surface of the container is slid into contact with the rear wall of the container supporting component protrudes into the aperture on the container supporting component, and a second projection on a side surface towards the front surface of the container which when the rear surface of the container is slid into contact with the rear wall of the container support component releasably engages with the clasp or latch member on the container supporting component, securing the container against both slidable and vertical movement with respect to the container supporting component.

2. The storage rack container restraining system of claim 1 additionally comprising a further extendable component which is slidably mounted to the elongate side members of the first component and including a pair of space-apart elongate side members, and at least one member connected extending between the side members, such that the container supporting component is indirectly slidably mounted on the first component by being slidably mounted on the further extendable component, and a slot for slidably mounting the container supporting component to the further extendable component.

3. The storage rack container restraining system of claim 2 additionally comprising a stop located on a rack or shelving to which the first component side members are connected for preventing the extendable component from slidably moving past said stop.

4. The storage rack container restraining system of claim 2 additionally comprising a stop located on at least one plates located at the rear end of the first component side members for preventing the extendable component from slidably moving past said stop.

5. The storage rack container restraining system of claim 2 additionally comprising a roller on the inwardly directed surfaces of the further extendable component side members over which the container supporting component side members can slide.

6. The storage rack container restraining system of claim 1 in which the first component elongate members are L-shaped members.

7. The storage rack container restraining system of claim 1 in which the L-shaped container supporting component side members include a base which is directed inwardly and on which at least a portion of the container is slidably supported.

8. The storage rack container restraining system of claim 7 in which a plurality of said first component, container supporting component, and container systems are connected to a rack providing a set of drawer-like storage arrangements.

9. The storage rack container restraining system of claim 8 in which the container is a rectangular box having a removable or pivotable lid.

10. The storage rack container restraining system of claim 9 additionally comprising a plurality of formations on the lid, and a plurality of corresponding formations in the lower surface of the container, such that the formations on the lid can engage with the corresponding formations in another similarly formed container to aid in securely stacking the containers vertically.

11. The storage rack container restraining system of claim 10 in which the formations on the lid are apertures, and the corresponding formations on the container are projections which are adapted to project into a corresponding one of the apertures.

12. The storage rack container restraining system of claim 10 in which the bolt member is a shot bolt which is biased to an engaging position by means of a spring.

* * * * *